US006789647B1

(12) United States Patent
Yeh

(10) Patent No.: US 6,789,647 B1
(45) Date of Patent: Sep. 14, 2004

(54) ESCAPE MECHANISM FOR HIGH-RISE

(76) Inventor: Chi-Hsang Yeh, 2nd Floor, No. 123, Huan-San Road, Section 2, Taipei (TW)

( * ) Notice: Subject to any disclaimer, the term of this patent is extended or adjusted under 35 U.S.C. 154(b) by 0 days.

(21) Appl. No.: 10/445,192

(22) Filed: May 27, 2003

(51) Int. Cl.[7] ..... A62B 1/20

(52) U.S. Cl. ..... 182/82; 182/36; 182/100

(58) Field of Search ..... 182/82, 3, 36, 182/9, 100; 248/228.1–228.6

(56) References Cited

U.S. PATENT DOCUMENTS 4,499,966 A * 2/1985 Milne et al. ..... 182/3
4,629,032 A * 12/1986 Armstrong ..... 182/9
4,828,072 A * 5/1989 Ho ..... 182/9
5,271,481 A * 12/1993 Rich ..... 182/3

* cited by examiner

*Primary Examiner*—Alvin C. Chin-Shue
(74) *Attorney, Agent, or Firm*—Dykema Gossett PLLC

(57) ABSTRACT

An escape mechanism for high-rise includes a safety rail and a safety facility. The safety facility is formed in a frame-like shape with an upper frame and a lower frame being constructed by two parallel short steel columns and fixedly connected together by thick steel plates. The upper frame and the lower frame are both movably and pivotally jointed by two parallel connecting rods connected with a transverse shaft, such that the upper frame and the lower frame may make relative movement in parallel with each other. In use, an escapee can be tied with a safety belt carrying a safety facility being sleeved into the safety rail, and scramble down by treading on the retractable pedals attached to the safety rail. In the event of an accidental stumble, the safety facility will be active immediately and thus prevent the escapee from further falling.

2 Claims, 5 Drawing Sheets

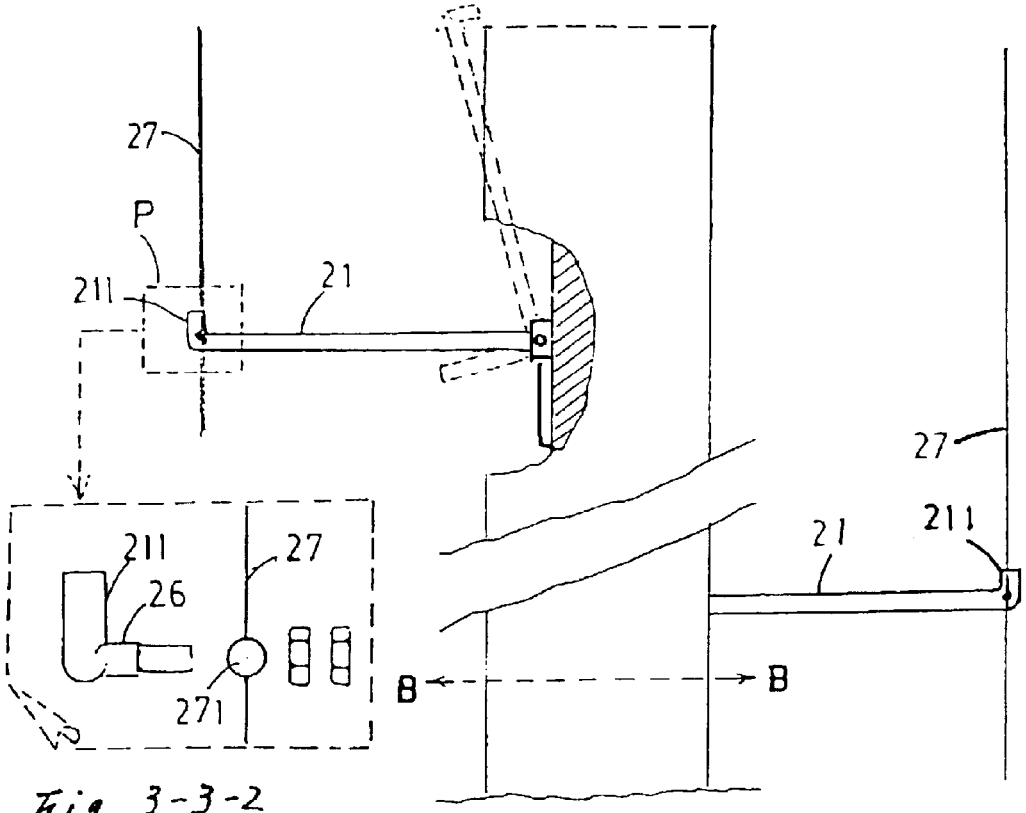
Fig. 3-3-2
Fig. 3-3-1
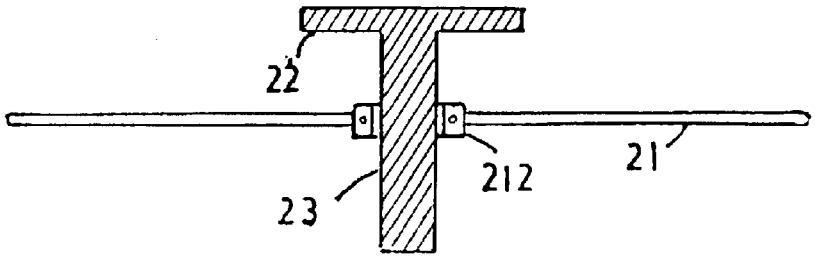
Fig. 3-4

ESCAPE MECHANISM FOR HIGH-RISE

TECHNICAL FIELD AND BACKGROUND OF THE INVENTION

In modern days, tall buildings and skyscrapers are soared everywhere in a metropolis. The build-up of high-rises draws the human life away from the ground. The advantages of living in a high-rise can be concluded with good views, sufficient ambient light, less dust and riddance of noise pollution. High-rises can provide better living environment, yet the degree of danger of living in a high-rise is far higher when compared to a low-rise. In particular, a conflagration may be the most dangerous factor fatal to the people living in a high-rise. Electric power or fuel gas may become the prime medium for a fierce conflagration. If a high-rise catches fire, the people living at higher floors of the high-rise not only can not escape to the higher floors or rooftop, but also can not escape to the lower floors or ground. Moreover, in most cases, the total height of a modern high-rise has been out of reach by a sky ladder. In the event of a conflagration, the only reliable appliance for helping people living in a high-rise flee to a place of safety depends on a variety of escape mechanisms specially designed for high-rise; for example, a decelerating emergence rope or a escape sling. These escape mechanisms for high-rise though have their intrinsic functionalities, they still have their own deficiencies. In fact, all kinds of these escape mechanisms for high-rise only can provide an opportunity for an escapee human to escape out of a fire; however, none of these conventional escape mechanisms for high-rise can be used by a group of people at the same time.

SUMMARY OF THE INVENTION

An innovation attained by the present invention is suggested based on the principle described above that provides an opportunity for an escapee to escape out of a fire. Generally, there are two requirements for an escape mechanism for high-rise, that is, functionality and cost-effectiveness. For example, if the construction budget of a high-rise is overspent, the completeness of the functionality of an escape mechanism for high-rise outfitted in the high-rise will be discounted in consideration of economic benefits. The escape mechanism for high-rise according to the present invention can satisfy these two requirements. The escape mechanism for high-rise according to the present invention is constructed by mounting a specially designed safety rail on selected pilasters and arranged with a plurality of specially designed safety facilities. In use, an escapee can be tied with a safety belt carrying a safety facility being sleeved into the safety rail, and scramble down by treading on the pedals attached to the safety rail. In the event of an accidental stumble, the safety facility will be active immediately and thus prevent the escapee from further falling to protect the life of escapee.

The present invention now will be explicated by the following descriptions with reference to the accompanying drawings.

BRIEF DESCRIPTION OF THE DRAWINGS

FIG. 3-1-1 is the front view of the safety rail.

FIG. 3-1-2 is the left-side view of the safety rail.

FIG. 3-2-1 is the front view of the rail seat.

FIG. 3-2-2 is the top view of the rail seat.

FIG. 3-2-3 is the left-side view of the rail seat.

FIG. 3-3-1 is the left-side view of the safety rail.

FIG. 3-3-2 is the enlarged view of the area P in FIG. 3-3-1.

FIG. 3-4 is the cross-sectional view taken along line B—B of FIG. 3-3-1.

FIG. 4-1 is the front view of the safety facility.

FIG. 4-2 is the top view of the safety facility.

FIG. 4-3 is the bottom view of the safety facility.

FIG. 4-4 is the right-side view of the safety facility.

FIG. 4-5 is the enlarged view of the safety bolt.

FIG. 5 is the cross-sectional view taken along line A—A of FIG. 4-2.

DETAILED DESCRIPTION OF THE PREFERRED EMBODIMENT

In order to obtain a better understanding to the present invention, descriptions of a preferred embodiment are given below with reference to the drawings attached therewith.

Figure 1:
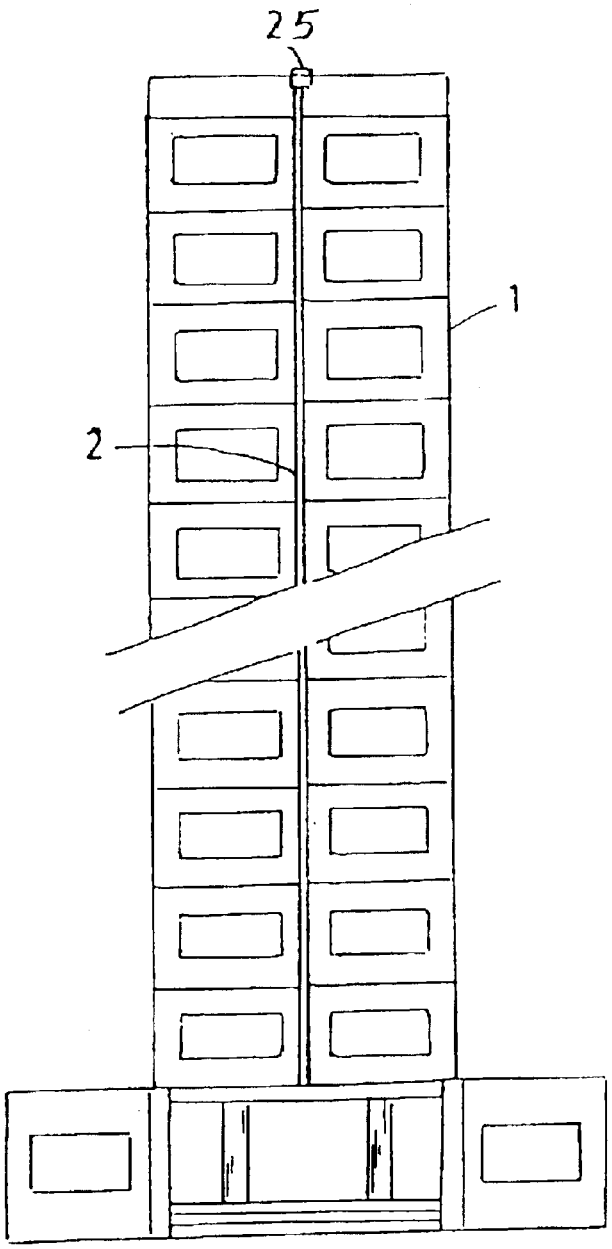
FIG. 1 is a diagram showing a skyscraper together with an escape mechanism for high-rise being installed therein according to the present invention.

FIG. 1 is a diagram showing a skyscraper together with an escape mechanism for high-rise being installed therein according to the present invention. It can be seen from the drawings that a safety sail (2) is fixedly anchored to selected pilasters of a high-rise, and a plurality of pedals (21) are mounted in a staggered fashion on the safety rail (2) and spreading out on both sides of the safety rail (2). In use, an escapee can be tied with a safety belt (not shown) carrying a safety facility (not shown) being sleeved into the safety rail (2). The escapee may scramble down by treading on the pedals (21). If an escapee stumbles accidentally, the safety facility can be brought into active to prevent the escapee from further falling, and then the escapee may make his choice to keep scrambling down by treading on the following pedals (21) or wait for rescue from other people. A single safety rail may be used by a group of people at the same time, and it is sufficient for a high-rise to create an escape mechanism by using a single safety rail. More advantageously, the construction of the safety facility is quite simple, and thus the total construction budget of a high-rise can be economized drastically.

Figure 2:
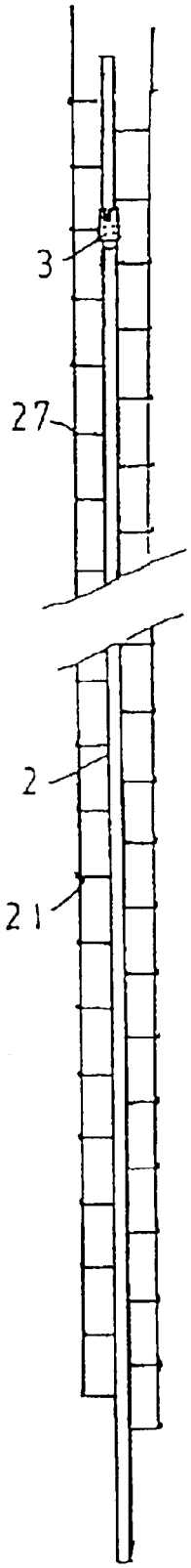
FIG. 2 is a diagram showing the safety rail according to the present invention.

FIG. 2 is a diagram showing the safety rail (2) according to the present invention. In FIG. 2, the safety rail (2) is provided with a plurality of pedals (21) arranged in a staggered fashion and spreading out on both sides of the safety rail (2) for an escapee to climb up with hands and scramble down with feet. In use, the escapee can sleeve the safety facility (3) into the safety rail (2) from the bottom direction or sleeve the safety facility (3) into the safety rail (2) from either sides of the safety rail (2). As a consequence, the safety facility (3) is fastened with a safety belt tied to an escapee. If an escapee stumbles accidentally, the safety facility (3) will stop slipping due to leverage action to protect the escapee from further falling.

Figures 1, 3:
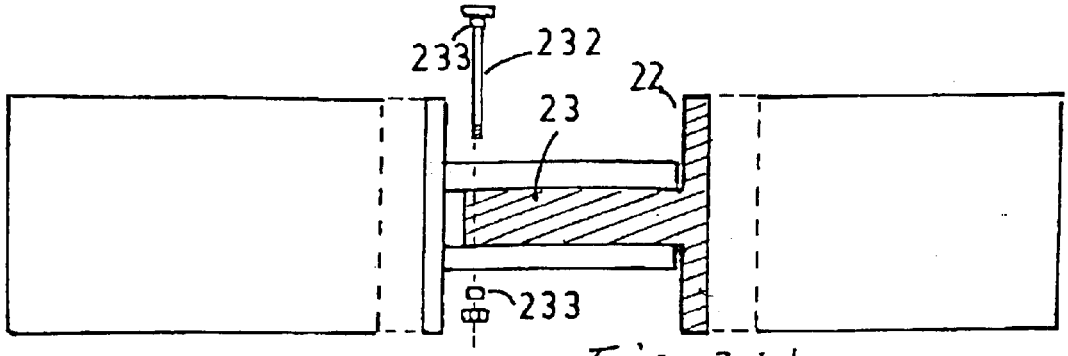
Figures 1, 2, 3:
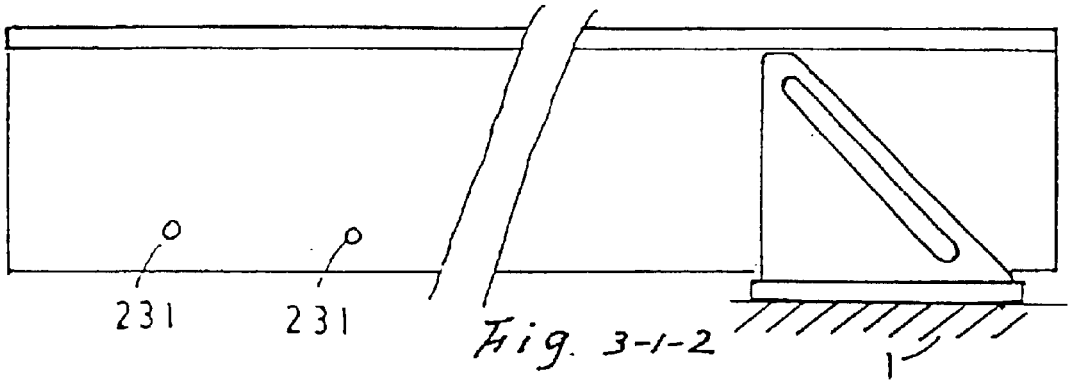
Figures 2, 3:
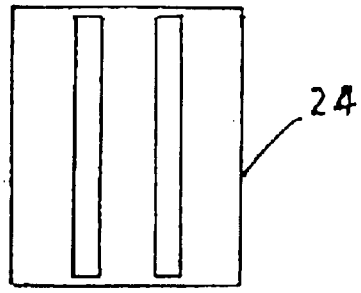
Figures 1, 2, 3:
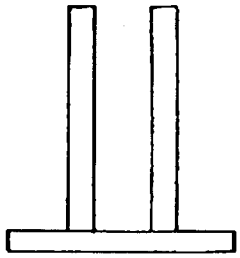
Figures 2, 3:
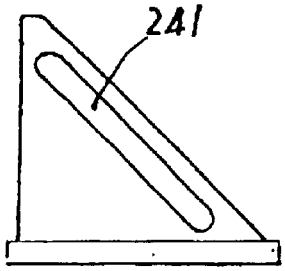
Figures 2, 4:
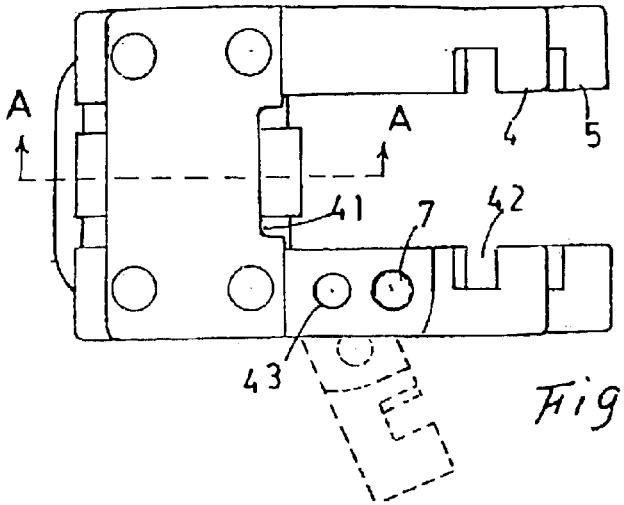

FIG. 3-1-1 is the front view of the safety rail. FIG. 3-1-2 is the left-side view of the safety rail. FIG. 3-2-1 is the front view of the rail seat. FIG. 3-2-2 is the top view of the rail seat. FIG. 3-2-3 is the left-side view of the rail seat. FIG. 3-4 is the cross-sectional view taken along line B—B of FIG. 3-3-1. It can be seen from the drawings that the cross-section of the safety rail (2) is in the shape of a capital letter "T", and the safety rail (2) includes a rail shoulder (22) and a rail body (23), both of which are molded by a light and rigid metal such as the aluminum alloy. The rail body (23) is mounted on a rail seat (24) and fixed with each other by longitudinal bolts (232). A plurality of mounting holes (231) penetrating the rail body (23) are spaced apart with each other by appropriate distance. The assembling process of the rail body (23) and the rail seat (24) is carried out by the following steps of fixing the rail seat (24) onto the high-rise (1), and settle the rail body (23) upon the center of the rail seat (24) by passing the longitudinal bolts (232) through the sliding groove (241) of the rail seat (24) and then passing through the mounting holes (231) of the rail body (23) and outstretching the other side of the rail body (23). By appropriate fastening between the rail body (23) and the rail seat (24), they can be movably connected with each other. In addition, small-sized bearings (233) are provided on both sides of the longitudinal bolts (232). As the longitudinal bolts (232) are passing through the sliding grooves (241) of the rail seat (24), the small-sized bearings (233) are fitted in the sliding grooves (241) so that the longitudinal bolts (232) can slide on the sliding grooves (241) of the rail seat (24) smoothly and obliquely in the up-and-down direction. As a result, the safety rail (2) can be automatically retracted upwards and inwards by the pulling force generated from the electromagnetic valve (25) provided thereabove. In use, the electromagnetic valve (25) is operated so that the safety rail (2) can be automatically floating up in an outward direction to be used by the users. A plurality of pedals (21) mounted in a staggered fashion and staggeringly spreading out on both sides of the rail body (23). On the outer side of each pedal (21), there is provided with an anti-slip hooks (211) protruding upwards for preventing an escapee from slipping and falling. The pedals (21) are movably mounted on a pedal base (212) and rotatable in an up and down direction by 90°. At the end of each pedal (21), there is provided with a connecting button (26) that connects the connecting wires (27) therewith, so that all the pedals (21) can be connected with each other. The upper ends of the connecting wires (27) are controlled by the electromagnetic valve (25) and thus the connecting wires (27) can be withdrawn or released within a limited extent. Under normal conditions, the electromagnetic valve (25) will withdraw the connecting wires (27) and retract the pedals (21) in an upward direction, so that the pedals (21) can be gathered up in order to avoid thievery by a burglar. In use, the pedals (21) can be rapidly spread out by operating the electromagnetic valve (25). When it is no longer used, the pedals (21) can be retracted by operating again the electromagnetic valve (25). As well known in the art, the electromagnetic valve is frequently used as a control means to control the on/off operation of an electrically-powered device, and the descriptions about its construction is therefore omitted.

FIG. 3-3-1 is the left-side view of the safety rail. FIG. 3-3-2 is the enlarged view of the area P in FIG. 3-3-1, in which the connecting button (26) is arranged on the right-hand side of the anti-slip hook (211). Each segment of the connecting wires (27) that are made up of thin steel wires is provided with a connecting ring (271). The pedals (21) can be all interconnected to form a chained member by fixing the connecting ring (271) to the connecting button (26).

Figures 4, 5:
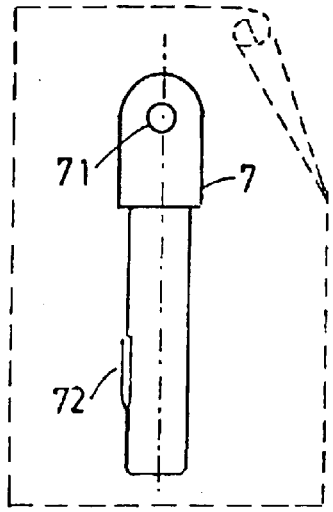
Figures 1, 4:
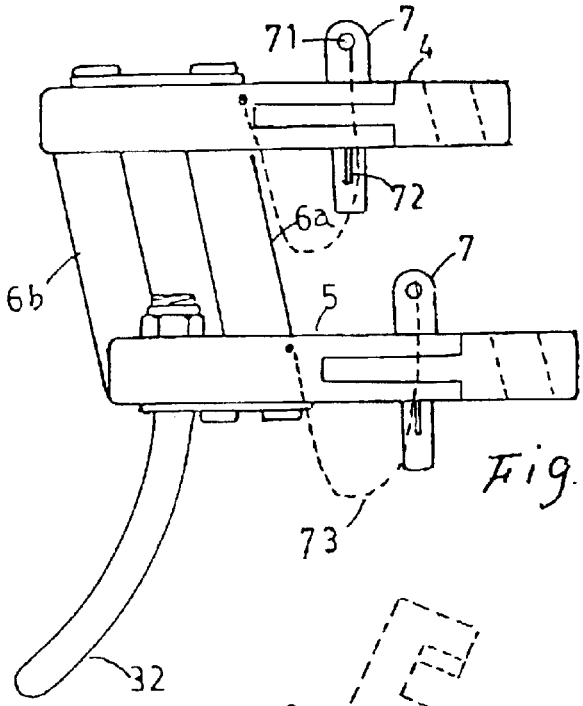
Figure 4:
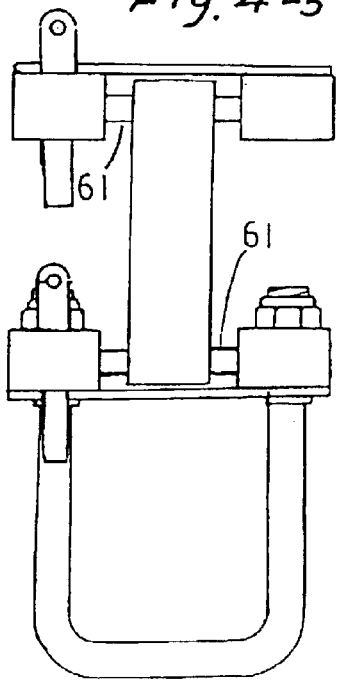
Figures 3, 4:
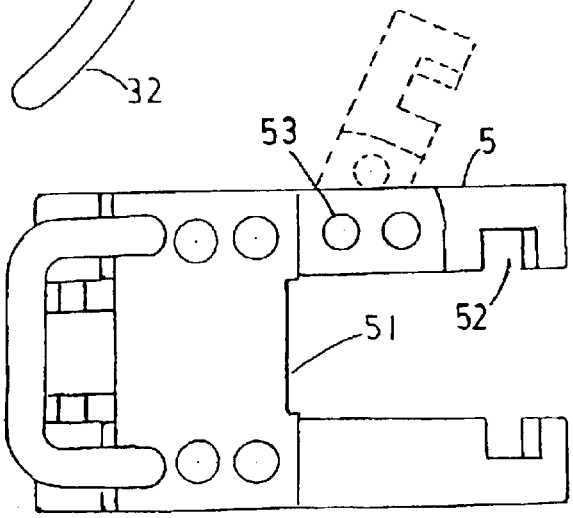
Figure 5:
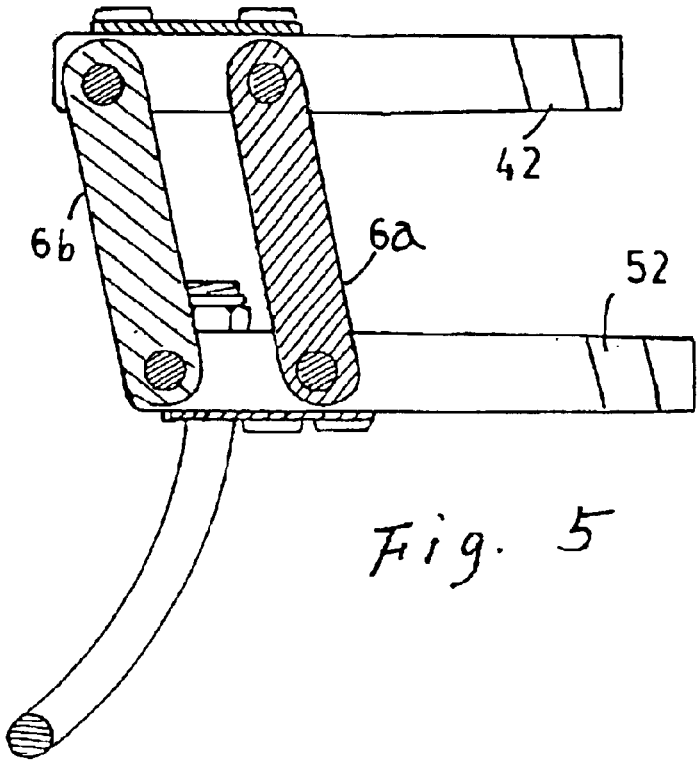

FIG. 4-1 is the front view of the safety facility. FIG. 4-2 is the top view of the safety facility. FIG. 4-3 is the bottom view of the safety facility. FIG. 4-4 is the right-side view of the safety facility. FIG. 4-5 is the enlarged view of the safety bolt. FIG. 5 is the cross-sectional view taken along line A—A of FIG. 4-2. It can be seen from the drawings that the safety facility is a frame-like body comprised of an upper frame and a lower frame being movably connected together, wherein the upper frame is constructed from two parallel short steel columns (4) being fixedly connected together by a thick steel plate (41), and likewise the lower frame is constructed from two parallel short steel columns (5) being fixedly connected together by a thick steel plate (51). The upper frame and the lower frame are jointed by two parallel connecting rods (6*a*, 6*b*) connected with a transverse shaft (61), such that the upper frame and the lower frame can make a relative movement with respect to each other. Safety grooves (42, 52) are respectively provided in the inner sides at the right end of the short steel column of the upper frame and the lower frame. A connecting ring (32) is mounted on a left end of the lower frame where the safety belt (31) is interlinked. For the purpose of facilitating the escapee to escape out of the fire without the need of running away to the rooftop and then fleeing for life to the ground, as long as the escapee approaches to windows or balcony near by the safety rail, he/she can tie the safety facility tight with himself/herself, sleeve the safety facility into the safety rail and then climb to the safety rail to flee away from the fire. As a consequence, each of the distal end of one of the short steel columns of the upper frame and the lower frame can be opened and closed. In use, the safety bolt can be pulled out so that the distal end of the short steel column of the upper frame can be pivotally twisted at a pivot axis (43) in an outward direction. By the same token, the distal end of the short steel column of the lower frame can be pivotally twisted at a pivot axis (53) in an outward direction, as shown by the dot line in the drawings. The safety facility (3) thus can be sleeved into the safety rail shoulder (22) from either sides of the safety rail shoulder (22) and anchored to the safety rail shoulder (22) by inserting the safety bolt (7) back, which is similar to the situation of sleeving the safety facility (3) from the top of the safety rail (2). For the sake of preventing the safety bolt (7) from falling down due to incaution or nervousness, a connecting hole (71) is arranged on the head part of the safety bolt (7) for allowing a connecting belt (73) to rigidly connect the safety bolt (7) to the short steel columns (4, 5).

FIG. 4-5 is an enlarged view of the safety bolt (7), wherein the safety bolt (7) shown in FIG. 4-5 is in the form of a thumbtack with a leaf spring (72) raising up in an outward direction being attached to one end thereof. As the safety bolt (7) is inserted, this leaf spring (72) will automatically pop out to ensure the fixation of the safety bolt (7) while preventing the safety bolt (7) from getting stripped off. If it is desired to pull out the safety bolt (7), it can be achieved by pressing the leaf spring (72) inwards and then the safety bolt (7) can be easily pulled out.

Figure 6:
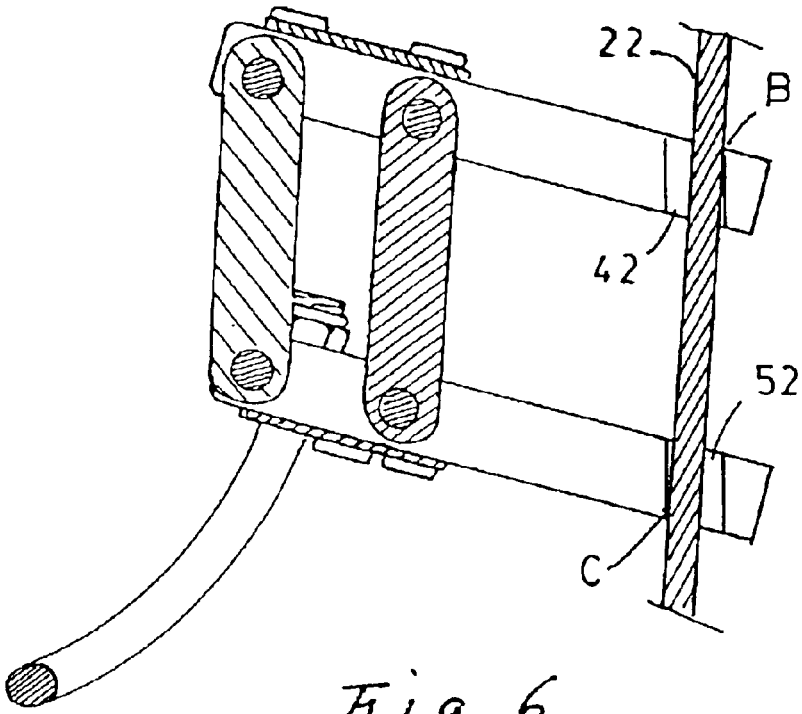
FIG. 6 illustrates the safety facility being sleeved into the safety rail shoulder and slid on the safety rail shoulder.

FIG. 6 illustrates the safety facility (3) being sleeved into the safety rail shoulder and slid on the safety rail shoulder (22). The width of the safety grooves (42, 52) is slightly larger than the thickness of the rail shoulder (22). If an escapee is stumbled, the safety belt (31) being attached to the escapee will be pulled down, and the connecting points between the safety belt (31) and the rail shoulder (22) will be points (B, C) within the bevels of the two safety grooves (42, 52). In this manner, forces will be generated so that a huge resistance is created between the safety facility (3) and the rail shoulder (22) to stop the safety facility (3) from further falling.

It is appreciated from the above statements that the escape mechanism for high-rise according to the present invention is the most effective and economical one among various kinds of escape mechanism for high-rise.

Although the present invention has been described and illustrated in detail, it is to be clearly understood that the same is by the way of illustration and example only and is not to be taken by way of limitation, the spirit and scope of the present invention being limited only by the terms of the appended claims.

What is claimed is:

1. An escape mechanism for high-rise comprising a safety facility and a safety rail, wherein the safety facility is constructed in a form of a frame-like shape comprising an upper frame and a lower frame being movably connected together with each other, both of the upper frame and the lower frame comprise two parallel short columns being fixedly connected with each other by a thick steel plate, and both of the upper frame and the lower frame are movably and pivotally jointed by two parallel connecting rods connected with a transverse shaft in order to allow the upper frame and the lower frame to make relative movements with each other, each of the inner sides of the two parallel short columns are provided with an oblique groove, wherein one of each upper and lower parallel short columns being pivotally connected to allow the parallel short columns to open and close in an outward direction.

2. An escape mechanism for high-rise of claim 1, wherein the cross-section of the safety rail is in the shape of a capital letter "T", and a plurality of mounting holes penetrating the rail body of the safety rail are spaced apart with each other by appropriate distance, and a rail seat bearing the rail body is provided with oblique sliding grooves for allowing a transverse pin extending through a mounting hole to slide thereon, a plurality of pedals are arranged in a staggering fashion on both sides of the safety rail, and said pedals are movably mounted on the safety rail on pedal bases and are rotatable in an up-and-down direction by 90°.

* * * * *